United States Patent [19]

Sugimoto et al.

[11] 4,129,351

[45] Dec. 12, 1978

[54] CONNECTOR ASSEMBLY FOR PRINTED CIRCUIT BOARD

[75] Inventors: Kazuyasu Sugimoto; Hiroshi Yamaya; Kameki Ishimoto, all of Kadoma, Japan

[73] Assignee: Matsushita Electric Industrial Company, Limited, Japan

[21] Appl. No.: 813,097

[22] Filed: Jul. 5, 1977

Related U.S. Application Data

[62] Division of Ser. No. 588,194, Jun. 19, 1975, abandoned.

[30] Foreign Application Priority Data

| | | | |
|---|---|---|---|
| Jun. 20, 1974 | [JP] | Japan | 49-71123 |
| Jun. 20, 1974 | [JP] | Japan | 49-71124 |
| Jun. 20, 1974 | [JP] | Japan | 49-71155 |
| Jun. 20, 1974 | [JP] | Japan | 49-73070 |
| Jun. 20, 1974 | [JP] | Japan | 49-73071 |

[51] Int. Cl.[2] ..... H01R 13/50

[52] U.S. Cl. ..... 339/176 MP; 339/17 LM; 339/75 MP; 339/91 R; 339/217 S

[58] Field of Search ..... 339/176 MP, 176 M, 91 R, 339/75 MP, 217 S, 17 M, 17 LM

[56] References Cited

U.S. PATENT DOCUMENTS

| | | | |
|---|---|---|---|
| 2,802,188 | 8/1957 | Badders | 339/176 MP X |
| 2,911,609 | 11/1959 | Burtt et al. | 339/176 MP X |
| 3,007,132 | 10/1961 | Anderson | 339/217 S |
| 3,243,761 | 3/1966 | Piorunneck | 339/176 MP |
| 3,246,280 | 4/1966 | Scagnelli | 339/176 MP X |
| 3,278,714 | 10/1966 | Bernutz | 339/91 R X |
| 3,573,706 | 4/1971 | Haberlen | 339/176 MP |
| 3,710,303 | 1/1973 | Gallager, Jr. | 339/176 MP X |
| 3,732,531 | 5/1973 | Bouley | 339/176 MP X |
| 3,812,452 | 5/1974 | Sturm | 339/176 MP X |
| 3,920,303 | 11/1975 | Pittman et al. | 339/91 R |
| 3,980,377 | 9/1976 | Oxley | 339/176 MP X |
| 4,025,147 | 5/1977 | Van Arsdale et al. | 339/176 MP |

*Primary Examiner*—Roy Lake
*Assistant Examiner*—DeWalden W. Jones
*Attorney, Agent, or Firm*—Robert E. Burns; Emmanuel J. Lobato; Bruce L. Adams

[57] ABSTRACT

A connector assembly for a printed circuit board having electrical contacts on at least one surface of its edge portion, comprising a housing structure having spaced parallel side wall portions at least one of which has electrical contact elements carried on the inner face thereof, and at least one elastic retaining member partly positioned within the housing structure and in engagement with at least one of the side wall portions of the housing structure for being in pressing engagement with the printed circuit board and thereby holding the circuit board in a predetermined fixed position having the contacts in close contact with the contact elements on the housing structure.

13 Claims, 20 Drawing Figures

CONNECTOR ASSEMBLY FOR PRINTED CIRCUIT BOARD

This is a divisional, of application Ser. No. 588,194, filed June 19, 1975 now abandoned.

The present invention relates to a connector assembly for a printed board having electrical contacts printed or otherwise formed on at least one surface of its edge portion.

A conventional connector for a printed circuit board comprises a housing structure having a pair of side walls which carry elastic contact elements arranged to be respectively in contact with the contacts on the edge portion of the printed circuit board fitted to the housing structure. The printed circuit board is held in position relative to the housing structure by the elasticity of the contact elements carried on the housing structure. In the event the housing structure or the printed circuit board is subjected to mechanical shocks or an impact during use, the printed circuit board may be dislodged from the housing structure or may be dislocated from its initial position relative to the housing structure. This will cause interruption of the electrical connection between the contacts on the printed circuit board and the contact elements on the housing structure. If, furthermore, the printed circuit board is forced against the contact elements on the housing structure with an excess of pressure which may be caused by an impact exerted on the printed circuit board or the housing structure, then the contact resistance at the surface of contact between each of the contacts on the circuit board and each of the contact elements on the housing structure will be unusually increased and provide a cause of shortened life of the printed circuit board and the connector assembly.

The housing structure is usually fastened to a mother board by means of screws which are driven through screw holes formed in extensions of the housing structure. Time consuming steps are therefore required in mounting the housing structure on the mother board during production of the connector assembly. To dispense with such elaborate steps, the contact elements which project outwardly from the bottom wall of the housing structure may be soldered or otherwise fixedly secured to the bottom wall as in some of the connector assemblies presently in use. In the prior art connector assembly of this nature, however, it is difficult to have the contact elements on the housing structure fixedly and assuredly connected to the mother board. If, furthermore, the printed circuit board or the connector assembly is subjected to mechanical shocks or impact during use, the contact elements on the housing structure tend to be moved on the contact-carrying edge portion of the printed circuit board and is also causative of an increase in the contact resistance between the contacts on the printed circuit board and the contact elements on the housing structure.

The present invention contemplates elimination of all these drawbacks that have been inherent in the prior art connector assemblies for printed circuit boards.

In accordance with the present invention, there is provided a connector assembly which comprises a housing structure having a pair of spaced parallel side wall portions forming therebetween an elongated groove open at its top end and a bottom wall portion located at the bottom of the elongated groove, at least one of the side wall portions having a plurality of electrical contacts carried on the inner face thereof, and at least one elastic retaining member at least in part positioned in the elongated groove and in engagement with at least one of the side wall portions of the housing structure for being in pressing engagement with at least one surface of the contact-carrying edge portion of a printed circuit board and thereby holding the printed circuit board in a predetermined fixed position having its contacts respectively in contact with the contact elements on the housing structure.

The features and advantages of the connector assembly according to the present invention will become more apparent from the following description taken in conjunction with the accompanying drawings in which like reference numerals designate corresponding portions, members and structures and in which.

Figure 18:
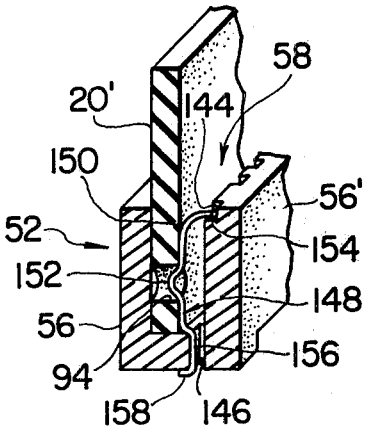
FIG. 18 is a perspective view showing still another preferred embodiment of the connector assembly according to the present invention.
Figure 18A:
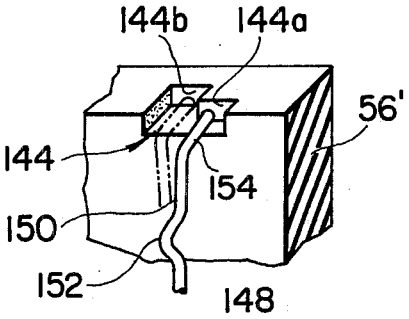
Figure 19:
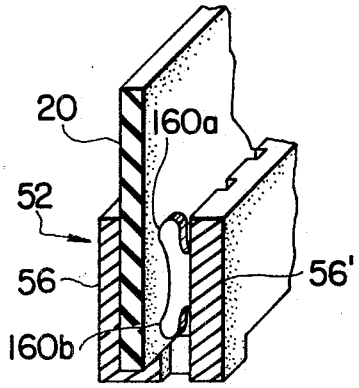

FIG. 18*a* is a fragmentary perspective view showing, to an enlarged scale, part of a modification of the embodiment illustrated in FIG. 18; and FIG. 19 is a fragmentary perspective view showing still another preferred embodiment of the connector assembly according to the present invention.

DESCRIPTION OF THE PREFERRED EMBODIMENTS

Figure 1:
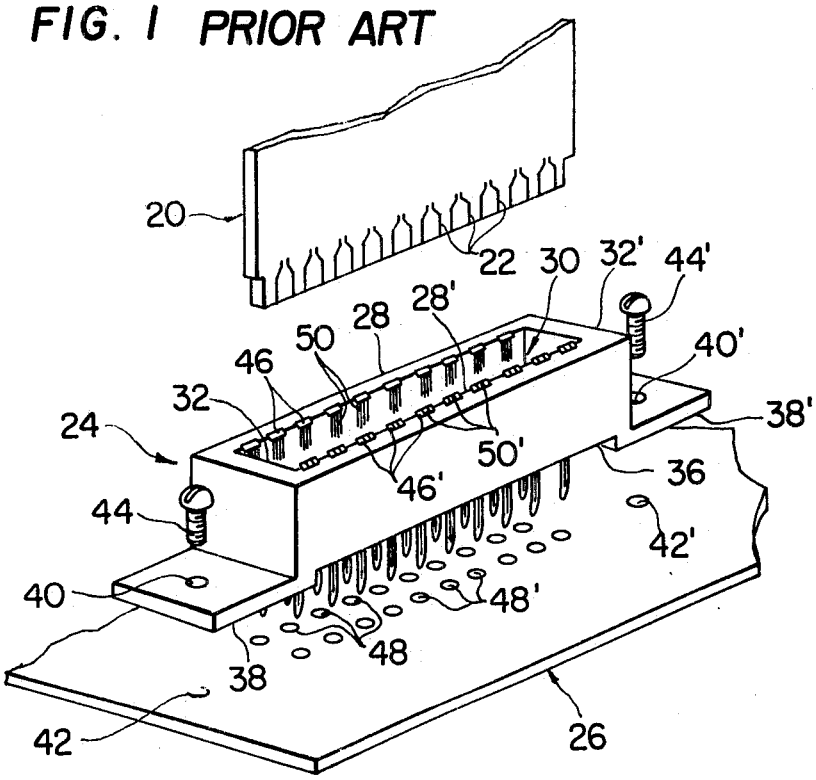
FIG. 1 PRIOR ART
FIG. 1 is a perspective view which shows a representative example of a prior art connector assembly for a printed circuit board.

Reference will now be made to the drawings, first to FIG. 1 which illustrates a representative example of the prior art connector assembly for a printed circuit board a portion of which is indicated by reference numeral 20. The printed circuit board 20 has a plurality of conductive contacts 22 which are arranged in an array on each or one of the surfaces of an edge portion of the board 20 and which are spaced apart, usually equidistantly, from each other as shown. The contacts 22 are, in this instance, assumed to be provided on both surfaces of the printed circuit board 20, although those on only one of the surfaces are seen in FIG. 1. The connector assembly is used for providing electrical connections from these contacts 22 of the printed circuit board 20 to leads of various external circuit components (not shown) of an electric equipment or instrumentation and is largely composed of a unitary housing structure 24 and a mother board 26 both of which are formed of electrically insulating material. The housing structure 24 is made up of a pair of spaced parallel side wall portions 28 and 28' forming an elongated groove 30 therebetween, a pair of end wall portions 32 and 32' located at the longitudinal ends of the elongated groove 30, a bottom wall portion 36 located at the bottom of the elongated groove 30, and a pair of longitudinal extensions 38 and 38' which project longitudinally outwardly from the lower ends of the end wall portions 32 and 32', respectively, the longitudinal extensions 38 and 38' being formed with screw holes 40 and 40', respectively. On the other hand, the mother board 26 is formed with screw holes 42 and 42' which are located in correspondence with the screw holes 40 and 40' in the logitudinal extensions 38 and 38', respectively, of the housing structure 24. The housing structure 24 is thus fixedly mounted on one face of the mother board 26 by means of screws 44 and 44' which are driven through the screw holes 40 and 40' and the screw holes 42 and 42', respectively.

The side wall portions 28 and 28' of the housing structure 24 thus constructed are formed with vertical grooves or recesses 46 and 46', respectively, which extend between the upper and lower ends of the respective inner faces of the side wall portions 28 and 28'. The vertical grooves or recesses 46 and 46' are located respectively in alignment with the contacts 12 on the opposite surfaces of the printed circuit board 20 and are open at the lower end of the bottom wall portion 36 respectively through apertures (not shown) which are formed in the bottom wall portion 36. The mother board 26 is formed with apertures 48 and 48' which are arranged in arrays corresponding to the apertures thus formed in the bottom wall portion 36 of the housing structure 24. The apertures 48 in the mother board 26 are respectively in alignment with the vertical grooves or recesses 46 in one side wall portion 28 of the housing structure 24 and likewise the apertures 48' in the mother board 26 are respectively in alignment with the vertical grooves or recesses 46' in the other side wall portion 28' of the housing structure 24. In the vertical grooves or recesses 46 and 46' are fixedly received limbs or elastic elongated contact elements 50 and 50', respectively. The contact elements 50 and 50' are passed through the apertures in the bottom wall portion 36 of the housing structure 24 and through the apertures 48 and 48', respectively, in the mother board 26 and project outwardly or downwardly from the underside of the mother board 26 for being connected to the leads of external circuit components (not shown).

The printed circuit board 20 is press fitted into the elongated groove 30 in the housing structure 24 and is thus snugly gripped between the inner faces of the side wall portions 28 and 28' of the housing structure 24. The contacts 22 of the printed circuit board 20 are thus respectively held in contact with the flexible contact elements 50 and 50' received in the vertical grooves or recesses 46 and 46' in the side wall portions 28 and 28' of the housing structure 24, providing electrical connection between each of the contacts 22 of the printed circuit board 20 and each of the contact elements 50 and 50' on the side wall portions 28 and 28' of the housing structure 24.

The printed circuit board 20 is retained to the housing structure 24 by reason of the elasticity of the contact elements 50 and 50' on the side wall portions 28 and 28' of the housing structure 24. In case, therefore, the connector assembly or the printed circuit board 22 is subjected to mechanical shocks or an impact during use, the printed circuit board 20 may be dislodged from the housing structure 24 or dislocated from its initial position relative to the housing structure 24, interrupting the electrical connections between the contacts [22] 22 of the circuit board 20 and the contact elements 50 on the housing structure 24. If, furthermore, the printed circuit board 20 is forced against the contact elements 50 or 50' by an increased pressure which may be caused by an impact exerted on the printed board 20 or the housing structure 24, there will result an increase in the contact resistance at the surface of contact between each of the contacts 22 of the printed circuit board 20 and each of the contact elements 50 and 50' on the housing structure 24. This will give rise to shortening of the life of the contact elements 50 and 50' and accordingly of the service life of the connector assembly as a whole, as previously noted.

As also pointed out previously, a time-consuming process is required in mounting the housing structure 24 on the mother board 26 during production of the connector assembly. To eliminate such a process, the contact elements 50 and 50' projecting outwardly from the bottom wall portion 36 of the housing structure 24 may be soldered or otherwise fixedly secured to the bottom wall portion 36 as in some of the prior art connector assemblies having basic configurations similar to that shown in FIG. 1. In the prior art connector assembly of this type, however, it is difficult to have the contact elements 50 and 50' firmly fixed to the mother board 26 and precisely positioned relative to the respectively associated contacts 22 of the printed circuit board 20. If, thus, the printed circuit board 20 or the connector assembly is subjected to mechanical shocks or impact during use, the contact elements 50 and 50' on the housing structure 24 tend to be moved on the respectively associated contacts 22 of the circuit board 20 and, as a consequence, cause an increase in the contact resistance between each of the contacts 22 of the printed circuit board 20 and the associated one of the contact elements 50 and 50' on the housing structure 24. The goal of the present invention is to provide a useful sollution to the above-mentioned problems which have thus far been inherent in the prior art connector assemblies for printed circuit boards.

Figure 2:
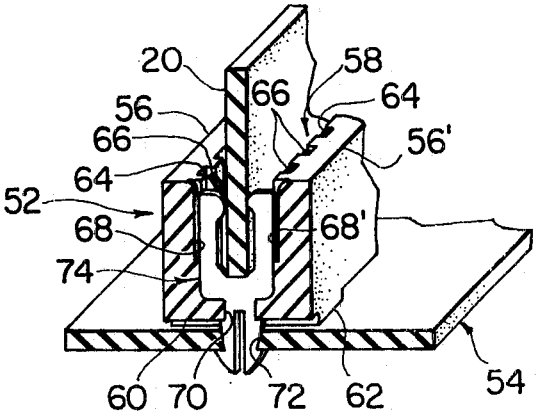
FIG. 2 is a fragmentary perspective view showing a preferred embodiment of a connector assembly according to the present invention.

Referring to FIG. 2, an embodiment of the present invention comprises a housing structure 52 and a mother board 54. The housing structure 52 and the mother board 54 are configured essentially similarly to their respective counterparts 24 and 26 in the prior art connector assembly shown in FIG. 1 except that the housing structure 52 is void of the longitudinal extensions 38 and 38' forming part of the housing structure 24 and accordingly that the mother board 54 is void of the screw holes 42 and 42' formed in the mother board 26. As will be understood as the description proceeds, the housing structure 52 is thus affixed to the mother board 54 without aid of the screws 44 and 44' which are used in the prior art connector assembly illustrated in FIG. 1.

Similarly to the housing structure 24 of the assembly shown in FIG. 1, the housing structure 52 of the embodiment illustrated in FIG. 2 has a pair of spaced parallel side wall portions 56 and 56' forming an elongated groove 58 therebetween and a bottom wall portion 60 located at the bottom of the elongated groove 58. The bottom wall portion 60 is integral with a base portion 62 extending from the lower face of the bottom wall portion 60 as illustrated. Each of the side wall portions 56 and 56' is formed with a number of vertical grooves or recesses 64 extending between the upper and lower ends of the inner face of the side wall portion and opening at the lower end of the bottom wall portion 60 respectively through apertures (not shown) which are formed in the bottom wall portion 60. The vertical grooves or recesses 64 are located in alignment with the contacts (not shown in FIG. 2) of the printed circuit board 20 to be fitted to the connector assembly, as in the case of the prior art connector assembly shown in FIG. 1. The mother board 54 is formed with apertures (not shown) which are located in alignment with the apertures thus formed in the bottom wall portion 60 of the housing structure 52. The vertical grooves or recesses 64 have fixedly received therein elastic elongated contact elements 66 which are passed through the apertures in the bottom wall portion 60 of the housing structure 52 and the apertures in the mother board 54 and which project outwardly from the outer face of the bottom wall portion 60 of the housing structure 52, though not shown in FIG. 2

The side wall portions 56 and 56' of the housing structure 52 are further formed with vertical grooves 68 and 68', respectively, which extend from the upper ends of the respective inner faces of the side wall portions 56 and 56' to the upper face of the bottom wall portion 60. The bottom wall portion 60 of the housing structure 52 is formed with a lateral slot 70 which is laterally in alignment with the vertical grooves 68 and 68' in the side wall portions 56 and 56'. For the reason to be explained later, the base portion 62 of the housing structure 52 is located to be offset from the position aligned with the vertical grooves 68 and 68' and the lateral slot 70 so that the slot 70 is open at the lower end of the bottom wall portion 60. On the other hand, the mother board 54 is formed with a slot 72 which is located in alignment with the lateral slot 70 in the bottom wall portion 60 of the housing structure 52 to be mounted on the mother board 54. As seen in FIG. 2, the slot 72 formed in the mother board 54 is reduced toward the lower end of the mother board 54, viz., away from the lower wall portion 60 of the housing structure 52 which is to be mounted on the upper face of the mother board 54.

The vertical grooves 68 and 68' in the side wall portions 56 and 56' and the lateral slot 70 in the bottom wall portion 60 of the housing structure 52 and the slot 72 in the mother board 54 are adapted to receive therein an elastic retainer member 74 which is to hold the printed circuit board 20 in a predetermined fixed position relative to the housing structure 52. The retaining member 74 is constructed by an elastic plate of, for example, metal or plastics and has a generally Y-shaped configuration which is composed, in an unstressed condition shown in FIG. 3, of a pair of spaced parallel side arm portions 76 and 76' extending jointly from a lateral intermediate portion 78 and formed with projections 80 and 80', respectively, at their free ends. The projections 80 and 80' are protruded laterally inwardly from the respective side arm, portions 76 and 76' and are spaced apart from each other a distance which is slightly smaller than the thickness of the printed circuit board 20 when the retaining member 74 is in the unstressed condition illustrated in FIG. 3. The side arm portions 76 and 76' are elastically deformable toward and away from each other in lateral direction of the retaining member 74 about the lateral intermediate portion 78 when pressed laterally inwardly and outwardly. The side arm portions 76 and 76' have a length which is substantially equal to the depth of the vertical groove 58 in the housing structure 52 as will be seen from FIG. 2. The retaining member 74 further comprises a bifurcated catch portion 82 which extends in a direction opposite to the side arm portions 76 and 76' through a longitudinal intermediate portion 84 integral with the lateral intermediate portion 78. The catch portion 82 is formed with an elongated recess 86 extending from the longitudinal intermediate portion 84 and terminating and opening at the leading end of the catch portion 82. The catch portion 82 is thus divided into a pair of spaced parallel limbs 88 and 88' extending from the longitudinal intermediate portion 84. The limbs 88 and 88' are elastically deformable toward and away from each other in lateral direction of the retaining member 74 about the longitudinal intermediate portion 84 when pressed laterally inwardly and outwardly. The limbs 88 and 88' are formed with first laterally outwardly stepped edges 90 and 90', respectively, located close to the longitudinal intermediate portion 84 and second laterally outwardly stepped edges 92 and 92', respectively, which are located close to the leading ends of the limbs 88 and 88'. If desired, the lateral intermediate portion 78 may be formed with a recess 78*a* in its lateral edge opposite to the longitudinal intermediate portion 84 as shown. The edge 78*a* preferably has a width which is substantially equal to the thickness of the printed circuit board 20 to be mounted on the connector assembly, for the reason which will be understood as the description proceeds.

The elastic retaining member 74 thus configured in the unstressed condition is press fitted to the housing structure 52 and the mother board 54 in such a manner but the side arm portions 76 and 76' are at least partly received in the vertical grooves 68 and 68' in the side wall portions 56 and 56', respectively, of the housing structure and that the limbs 88 and 88' of the catch portion 82 are closely received in the slot 72 in the mother board 54 so that the housing structure 52 and the mother board 54 are closely fastened to each other by means of the catch portion 82 of the retaining member 74 as seen in FIG. 2. The lateral intermediate portion 78 of the retaining member 74 is held in contact with the upper face of the bottom wall portion 60 of the housing structure 54 whilst the longitudinal intermediate portion 84 is closely received in the lateral slot 70 in the bottom wall portion 60 of the housing structure 52. The lower face of the bottom wall portion 60 of the housing structure 52 is slightly spaced apart from the upper face of the mother board 54 because of the base portion 62 located between the bottom wall portion 60 of the housing structure 52 and the upper face of the mother board 54. The first laterally outwardly stepped edges 90 and 90' of the limbs 88 and 88' constituting the catch portion 82 of the retaining member 74 are thus held in close contact with the lower face of the bottom wall portion 60 of the housing structure 52 and, likewise, the second laterally outwardly stepped edges 92 and 92' of the limbs 88 and 88' are held in close contact with the lower face of the mother board 54 with the respective leading end portions of the limbs 88 and 88' projecting outwardly from the lower face of the mother board 54.

For the purpose of assembling the retaining member 74 into the above described position in the housing structure 52 and the mother board 54 which are initially separate from each other, the retaining member 74 is first inserted from over the housing structure 52 into the elongated groove 58 in the housing structure 52 and is downwardly guided along the grooves 68 and 68' in the side wall portions 56 and 56' of the housing structure 52 until the limbs 88 and 88' of the catch portion 82 are brought into abutting engagement with the bottom wall portion 60 of the housing structure 52. The limbs 88 and 88' are then passed laterally inwardly so as to be elastically deformed toward each other and are thus passed through the lateral slot 70 in the bottom wall portion 60 of the housing structure 52 until the lateral intermediate portion 78 is brought into contact with the upper face of the bottom wall portion 60 of the housing structure 52 and at the same time the first laterally outwardly stepped edges 90 and 90' of the limbs 88 and 88' forming the catch portion 82 become flush with the lower face of the bottom wall portion 60 of the housing structure 52 with the longitudinal intermediate portion 84 received in the lateral slot 70 in the bottom wall portion 60. The limbs 88 and 88' of the catch portion 82 are thereafter inserted, still in the laterally inwardly pressed condition, through the slot 72 in the mother board 54 until the second laterally outwardly stepped edges 92 and 92' of the limbs 88 and 88' become flush with the lower face of the mother board 54 with the leading end portions of the limbs 88 and 88' projecting outwardly from the lower face of the mother board 54. When the limbs 88 and 88' of the catch portion 82 are released from the pressures urging the limbs laterally inwardly, then the limbs 88 and 88' are allowed to resume their initial positions and have the first laterally outwardly stepped edges 90 and 90' held in close contact with the lower face of the bottom wall portion 60 of the housing structure 52 and the second laterally outwardly stepped edges 92 and 92' held in close contact with the lower face of the mother board 54 as shown in FIG. 2.

When the connector assembly is thus complete with the retaining member 74 engaged by the housing structure 52 and the mother board 54, the printed circuit board 20 is forced in between the inward projections 80 and 80' of the side arm portions 76 and 76' of the retaining member 74 against the opposing forces resulting from the elasticity of the side arm portions and is downwardly moved until the end of the contact-carrying edge portion of the printed circuit board 20 is received by the lateral intermediate portion 78, preferably in the recess 78*a* in the intermediate portion 78 of the retaining member 74 as seen in FIG. 2. The printed circuit board 20 is in this manner closely held in a predetermined fixed position relative to the connector assembly, having its contact-carrying edge portion pressed between the inward projections 80 and 80' of the side arm portions 76 and 76', respectively, of the elastic retaining member 74. The conductive contacts carried on the edge portion of the printed circuit board 20 are thus respectively maintained in contact with the individual contact elements carried on inner faces of the side wall portions 56 and 56' of the housing structure 52.

Figure 3:
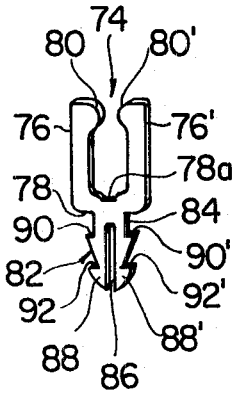
FIG. 3 is a perspective view which shows an unstressed condition of a retaining member forming part of the embodiment illustrated in FIG. 2.
Figure 4:
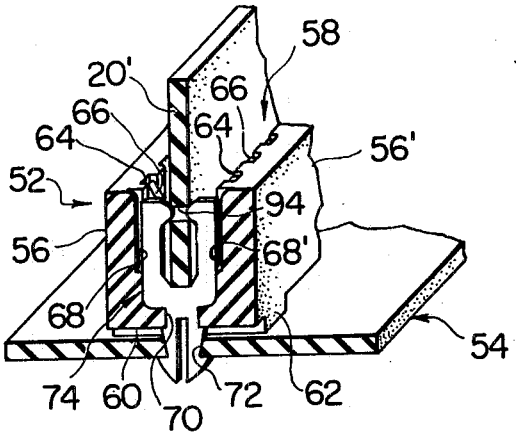
FIG. 4 is a fragmentary perspective view showing a modification of the embodiment illustrated in FIG. 2.

FIG. 4 illustrates another preferred embodiment of the connector assembly according to the present invention. The embodiment shown in FIG. 4 is a modification of the embodiment thus far described with reference to FIGS. 2 and 3 and is thus composed of a housing structure 52, a mother board 54 and a retaining member 74 all of which are constructed and arranged essentially similarly to their respective counterparts in the embodiment shown in FIG. 2. The embodiment shown in FIG. 4 is, however, adapted for use with a printed circuit board 20' which has an aperture 94 formed in its contact-carrying edge portion for receiving therein tip portions of the inward projections 80 and 80' of the side arm portions 76 and 76' of the elastic retaining member 74 as illustrated. The aperture 94 in the contact-carrying edge portion of the printed circuit board 20' is, for this purpose, in a predetermined position relative to the retaining member 74 or, more exactly, to the inward projections 80 and 80' of the side arm portions 76 and 76' of the retaining member 74 affixed to the housing structure 52 and the mother board 54. When the contact-carrying edge portion of the printed circuit board 20' is held in a predetermined fixed position relative to the retaining member 74 in the connector assembly, the inward projections 80 and 80' of the side arm portions 76 and 76' of the retaining member 74 are partly received in the aperture 94 in the printed circuit board 20' and thus prevent the printed circuit board 20' from being dislodged or dislocated from the predetermined position thereof in both vertical and longitudinal directions of the housing structure 52. Where the printed circuit board 20' is fitted to the connector assembly by manual operations, the operator will be capable of easily perceiving, at his finger-tips, the proper engagement achieved between the printed circuit board 20' and the retaining member 74 by the snap actions of the projections 80 and 80' received in the aperture 94 in the circuit board 20'.

Figure 5:
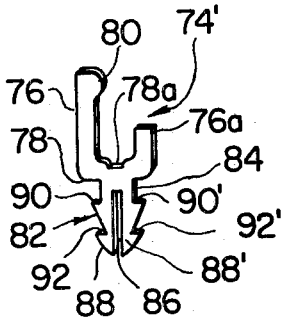
FIG. 5 is a perspective view which shows an unstressed condition of a retaining member forming part of the embodiment illustrated in FIG. 4.
Figure 6:
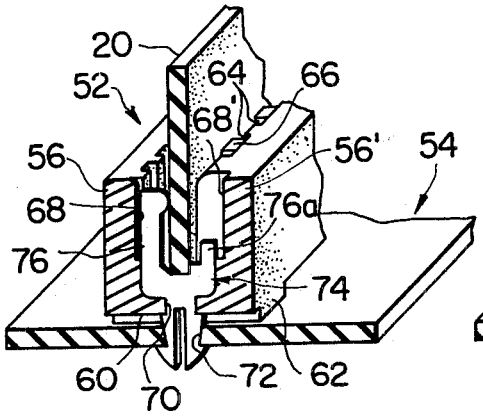
FIG. 6 is a fragmentary perspective view showing another modification of the embodiment illustrated in FIG. 2.
Figure 7:
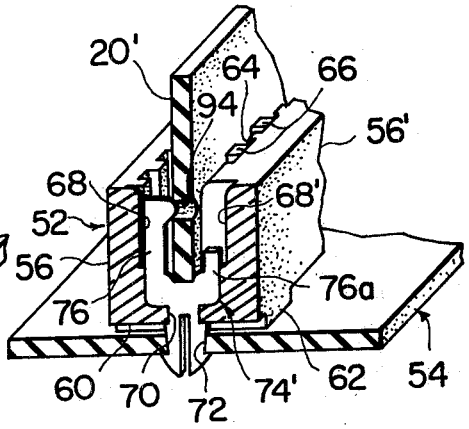
FIG. 7 is a fragmentary perspective view showing still another modification of the embodiment illustrated in FIG. 2.

The printed circuit boards 20 and 20' for use with the embodiments shown in FIGS. 2 and 4 have been assumed to have the conductive contacts carried on both faces of each of the circuit boards. If, however, the printed circuit board 20 or 20' is provided with conductive contacts carried on only one of the faces thereof so that the housing structure 52 has the contact elements 66 carried on the inner face of only one of the side wall portions 56 and 56' thereof, then the retaining member 74 for holding the printed circuit board 20 and 20' may be so configured as to have one of its side arm portions 76 and 76' cut off or terminated halfway. FIG. 5 illustrates an example of such a retaining member which is now designated by 74' and FIGS. 6 and 7 illustrate embodiments of the connector assembly in which a non-apertured printed circuit board 20 or an apertured printed circuit board 20' is held in position by means of the retaining member 74'. As shown in FIG. 5, the retaining member 74' has side arm portions 76 and 76*a* which are jointly bifurcated from a lateral intermediate portion 78. The lateral intermediate portion 78 is shown to be formed with a lateral recess 78*a* having a width substantially equal to the thickness of the printed circuit board to be received by the retaining member 74'. One side arm portion 76 has a length substantially equal to the length of the vertical groove 68 in the side wall portion 56 of the housing structure 52 as will be seen in FIG. 6 or 7 and is formed with an inward projection 80 at its upper end similarly to each of the side arm portions 76 and 76' in each of the embodiments shown in FIGS. 2 and 4. The other side arm portion 76*a* is shorter than the above-mentioned side arm portion 76 and has a plain free end which is located halfway of the length of the vertical groove 68' in the side wall portion 56' of the housing 52 when the retaining member 74 is assembled to the housing structure 52 as shown in FIG. 6 or 7. The retaining member 74' is in other respects similar to the retaining member 74 illustrated in FIG. 3, thus having a bifurcated catch portion 82 extending in a direction opposite to the side arm portions 76 and 76*a* from the lateral intermediate portion 78 through a longitudinal intermediate portion 82. As seen in FIG. 5, the catch portion 82 of the retaining member 74' is also divided by an elongated slot 86 into a pair of spaced parallel limbs 88 and 88' which is formed with first stepped edges 90 and 90' and second stepped edges 92 and 92'. The retaining member 74' which is configured in this fashion may be used either with a non-apertured printed circuit board 20 as in the embodiment shown in FIG. 6 or with an apertured printed circuit board 20' formed with an aperture 94 in its contact-carrying edge portion as illustrated in FIG. 7. In each of the embodiments shown in FIGS. 6 and 7, it is assumed that the housing structure 52 has contact elements 66 carried in the vertical grooves 64 in the side wall portion 56' alone of the housing structure 52. In whichsoever arrangement of the embodiments shown in FIGS. 6 and 7, the side arm portions 76 and 76*a* of the retaining member 74' are closely received between the lower parts of the inner faces of the side wall portions 56 and 56' of the housing structure 52 and at the same time the lateral intermediate portion 78 of the retaining member 74' is closely received on the upper face of the bottom wall portion 60 of the housing structure 52. When, thus, the non-apertured printed circuit board 20 is inserted into the elongated groove 58 in the housing structure 52 and is fitted to the retaining member 74' in the embodiment illustrated in FIG. 6, the longer side arm portion 76 of the retaining member 74' received in the vertical groove 68 in the side wall portion 56 of the housing structure 52 has its inward projection 80 held in pressing engagement with one face of the printed circuit board 20 which has the end of its contact-carrying edge portion received on the recess 78*a* in the lateral intermediate portion 78 of the retaining member 74'. The shorter side arm portion 76*a* of the retaining member 74' terminates halfway in the vertical groove 68' in the side wall portion 56' of the housing structure 52. The printed circuit board 20 is thus elastically pressed over the other face of its contact-carrying edge portion against the contact elements 66 on the inner face of the side wall portion 56' of the housing structure 52. On the other hand, the apertured printed circuit board 20' fitted to the retaining member 74' in the embodiment illustrated in FIG. 7 has captured in its aperture 94 a portion of the inward projection 80 of the longer side arm portion 76 of the retaining member 74'. The printed circuit board 20' is therefore not only elastically pressed against the contact elements 66 on the inner face of the side wall portion 56' of the housing structure 52 but prevented from being dislodged or dislocated from its predetermined initial position relative to the housing structure 52.

Figure 8:
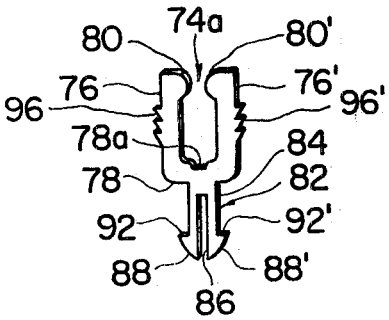
FIGS. 8 and 9 are perspective views each showing a modification of the retaining member illustrated in FIG. 3.
Figure 9:
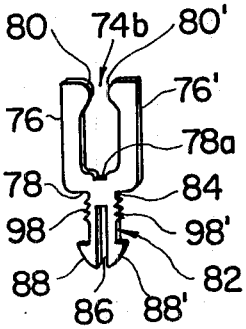

FIGS. 8 and 9 illustrate modifications of the elastic retaining member 74 incorporated in each of the embodiments thus far described with reference to FIGS. 2 and 4. The modified retaining members, now designated by 74*a* and 74*b* respectively, are thus adapted each for use with a printed circuit board having conductive contacts carried on both surfaces thereof.

The retaining member 74*a* illustrated in FIG. 8 is characterized in that the side arm portions 76 and 76' bifurcated from the lateral intermediate portion 78 are formed with teeth 96 and 96', respectively, on their lateral outer edges and that the limbs 88 and 88' constituting the catch portion 82 are void of the previously mentioned first laterally outwardly stepped edges and are thus formed only with laterally outwardly stepped edges 92 and 92', respectively, which are located close to the leading ends of the limbs 88 and 88'. When the retaining member 74*a* thus configured is assembled to the housing structure 52 and the mother board 54, the teeth 96 and 96' are brought into close contact with the elastic contact elements 66 on the inner faces of the side wall portions 56 and 56' of the housing structure 52 and at the same time the laterally outwardly stepped edges 92 and 92' are brought into close contact with the lower face of the mother board 54, though not shown in FIG. 8. It is apparent that the teeth 96 and 96' may be replaced by any other forms of roughened surfaces and may be formed also on the side arm portions 76 and 76' of the retaining member 74 having the configuration illustrated in FIG. 3 if desired.

On the other hand, the retaining member 74*b* shown in FIG. 9 has side arm portions 76 and 76' similar to those of the retaining member 74 shown in FIG. 3 and differs from the retaining member 74 in that the laterally outwardly stepped edges 90 and 90' formed on the limbs 88 and 88' in the vicinity of the longitudinal intermediate portion 84 are replaced with teeth 98 and 98', respectively. When the retaining member 74*b* thus formed is assembled to the housing structure 52 and the mother board 54, the teeth 98 and 98' on the outer edges of the limbs 88 and 88' constituting the catch portion 82 are partly in contact with the wall surfaces defining the lateral slot 70 in the bottom wall portion 60 of the housing structure 52 and partly in contact with the wall surfaces defining the slot 72 in the mother board 54, though not shown in FIG. 9. It is apparent that the teeth 98 and 98' may be replaced by any other forms of roughened surface and may also be formed on the limbs 88 and 88' of the retaining member 74*a* shown in FIG. 8, if desired.

Figure 10:
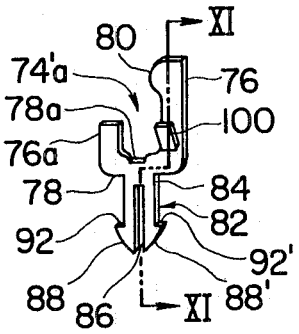
FIG. 10 is a perspective view showing a modification of the retaining member illustrated in FIG. 5.
Figure 11:
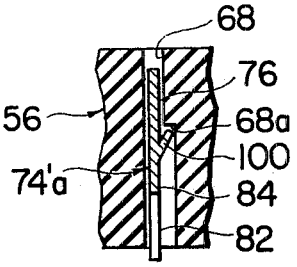
FIG. 11 is a sectional view showing an arrangement in which the retaining member shown in FIG. 10 is fitted to the housing structure of the connector assembly, the section of the retaining member being taken on line XI—XI of FIG. 10.

FIG. 10 illustrates a modification of the retaining member 74' shown in FIG. 5. The modified retaining member, designated by 74'*a* is thus adapted for use with a printed circuit board having conductive contacts carried on only one of the surfaces of the board as in each of the embodiments described with reference to FIGS. 6 and 7. In contrast to the retaining member 74' shown in FIG. 5, the modified retaining member 74'*a* is characterized in that the longer side arm portion 76 thereof is provided with a projection 100 which projects angularly upwardly from one face of the side arm portion 76 and which is thus elastically deformable toward and away from the face of the side arm portion 76 about the lower end of the projection 100. As seen in FIG. 11 which illustrates a condition in which the retaining member 74'a is fitted to the housing structure 52, one of the side walls defining the vertical groove 68 therebetween in the side wall portion 56 of the housing structure 52 is stepped as at 68a away from the other of the side walls defining the groove 68 in the longitudinal direction of the side wall portion 56. The stepped wall 68a is located to be in engagement with the upper leading end of the projection 100 on the side arm portion 76 of the retaining member 74'a as shown in FIG. 11 when the side arm portion 76 of the retaining member 74'a is slipped along the vertical groove 68 in the side wall portion 56 into a position to have the retaining member 74'a snugly fitted to the housing structure 52. The retaining member 74a thus assembled to the housing structure 52 is prevented from being vertically moved relative to the housing structure 52 by reason of the engagement between the projection 100 on the side arm portion 76 of the retaining member 74'a and the stepped wall 68a defining part of the vertical groove 68 receiving the side arm portion 76. It is apparent that the entity like the projection 100 provided on the longer side arm portion 76 of the retaining member 74'a may also be provided on the shorter side arm portion 76a or on one or each of the side arm portions 76 and 76' of each of the retaining members 74, 74a and 74b shown in FIGS. 3, 8 and 9, respectively, if desired.

Figure 12:
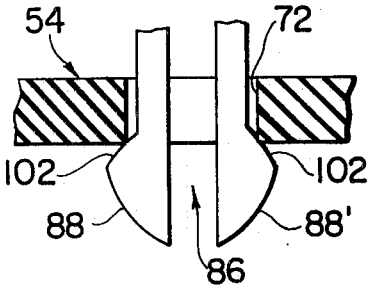
FIG. 12 is a fragmentary sectional view showing a modification of each of the retaining members shown in FIGS. 2 to 11.

In each of the embodiments thus far described with reference to FIGS. 2 to 11, the laterally outwardly stepped edges 92 and 92' formed on the leading end portions of the limbs 88 and 88', respectively, of the catch portion 82 of the retaining member have been assumed to have flat surfaces which are perpendicular to the limbs 88 and 88' and which are accordingly brought into contact with the lower face of the mother board 54 over their entire areas. If preferred, however, the stepped edges formed on the limbs 88 and 88' may be inclined laterally downwardly as indicated at 102 and 102' in FIG. 12 so that the stepped edges 102 and 102' are in contact with the edges defining the opposite ends of the slot 82 in the mother board 54. Thus, close engagement between the limbs 88 and 88' of the catch portion 82 of the retaining member can be achieved easily and assuredly even though the sizes of the limbs 88 and 88' of the retaining member manufactured on a large-scale commercial basis are strictly not matched with the side of the slot 72 in the mother board 54.

Figure 13:
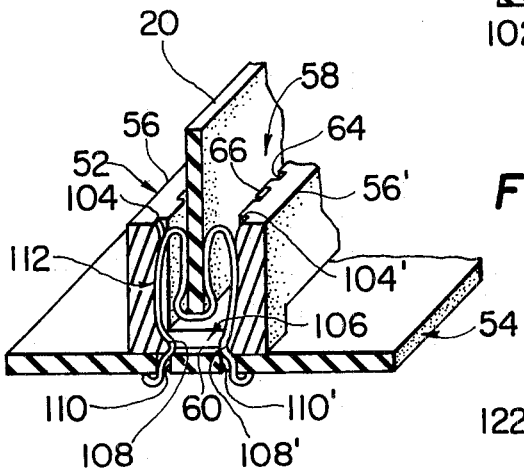
FIG. 13 is a fragmentary perspective view showing still another preferred embodiment of the connector assembly according to the present invention.

FIG. 13 illustrates still another preferred embodiment of the connector assembly according to the present invention. Similarly to each of the embodiments which have thus far been described, the embodiment shown in FIG. 13 comprises a housing structure 52 and a mother board 54. The housing structure 52 is composed of spaced parallel side wall portions 56 and 56' forming an elongated groove 58 therebetween and a bottom wall portion 60. Each of the side wall portions 56 and 56' is formed with vertical grooves or recesses 64 carrying therein elastic contact elements 66, respectively, as previously mentioned in connection with the embodiment illustrated in FIG. 2.

In the embodiment shown in FIG. 13, the side wall portions 56 and 56' of the housing structure 52 are further formed with vertical grooves 104 and 104', respectively, which extend between the upper and lower ends of the inner faces of the side wall portions 56 and 56'. While the vertical grooves 68 and 68' formed in the side wall portions 56 and 56' of the housing structure 52 incorporated into each of the embodiments thus far described extend straight in parallel to the inner faces of the side wall portions 56 and 56', each of the vertical grooves 104 and 104' in the side wall portions 56 and 56' of the housing structure 52 in the embodiment shown in FIG. 13 has a bottom surface having an intermediate portion which is curved laterally outwardly from the elongated groove 58 in the housing structure 52, viz., toward the outer face of the side wall portion in which the groove is formed. On the other hand, the bottom wall portion 60 of the housing structure 52 shown in FIG. 13 is formed with a lateral slot 106 which merges at its opposite ends into the lower ends of the above-mentioned vertical grooves 104 and 104' in the side wall portions 56 and 56'. The vertical grooves 104 and 104' in the side wall portions 56 and 56' are thus open at the lower end of the bottom wall portion 60 through the opposite ends of the lateral slot 106 in the bottom wall portion 60. The opposite ends of the lateral slot 106 in the bottom wall portion 60 are defined by wall portions 108 and 108' which protrude toward each other, viz., laterally inwardly of the housing structure 52. The mother board 54 is formed with a pair of holes 110 and 110' which are respectively located substantially in alignment with the opposite ends of the lateral slot 106 in the bottom wall portion 60, viz., approximately below the lower ends of the vertical grooves 104 and 104' in the side wall portions 56 and 56', respectively, of the housing structure 52 which is to be mounted on the mother board 54.

Figure 14:
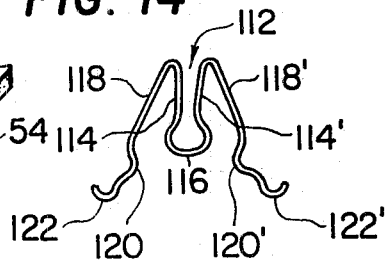
FIG. 14 is a perspective view showing an unstressed condition of a retaining member incorporated in the embodiment illustrated in FIG. 13.

The embodiment shown in FIG. 13 further comprises an elastic retaining member 112 to hold a printed circuit board 20 in a predetermined fixed position relative to the housing structure 52. The retaining member 112 is constructed of an elastic metal wire such as for example a music wire and has a generally M-shaped configuration consisting, in an unstressed condition shown in FIG. 14, of a pair of intermediate portions 114 and 114' merging into each other through a semicircularly curved middle portion 116 and extending substantially or at least partly in parallel with each other, a pair of side arm portions 118 and 118' turned backwardly from the leading ends of the intermediate portions 114 and 114' and angularly spaced apart sidewise outwardly from the intermediate portions 114 and 114', respectively, a pair of snap portions 120 and 120' semicircularly curved laterally inwardly from the leading ends of the side arm portions 118 and 118', respectively, and end portions 122 and 122' sidewise bent or curved laterally outwardly from the leading ends of the snap portions 120 and 120', respectively. The snap portions 120 and 120' are curved or protruded conformingly to the surfaces of the above-mentioned protruded wall portions 108 and 108', respectively, defining the lateral slot 106 in the bottom wall portion 60 of the housing structure 52. For the reason to be explained later, furthermore, the end portions 122 and 122' of the retaining member 112 are preferably semicircularly turned back from the leading ends of the snap portions 120 and 120', respectively, as shown in FIG. 14.

The elastic retaining member 74 thus configured in the unstressed condition is press fitted to the housing structure 52 and the mother board 54 in such a manner that the snap portions 120 and 120' are closely received on the surfaces of the protruded wall portions 108 and 108' of the housing structure 52 and with the end portions 122 and 122' partly passed through the holes 110 and 110' in the mother board 54 as seen in FIG. 13. The previously mentioned curved bottom surfaces of the vertical grooves 104 and 104' in the side wall portions 56 and 56', respectively, of the housing structure 52 are thus at least partly held in pressing engagement with the side arm portions 118 and 118', respectively, of the retaining member 112. The intermediate portions 114 and 114' of the retaining member 112 are consequently forced toward each other in the lateral direction of the housing structure 52 and at the same time the end portions 122 and 122' of the retaining member 112 have their respective tips forced against the lower face of the mother board 54 by reason of the elasticity of the retaining member 112. The housing structure 52 and the mother board 54 are thus closely fastened to each other by engagement between the retaining member 74 and the mother board 54 without use of any extra fastening means.

To have the retaining member 112 fitted to the housing structure 52 and the mother board 54 which initially are separate from each other, the retaining member 112 is first inserted into the elongated groove 58 in the housing structure 52 from the top or bottom of the housing structure so that the side arm portions 118 and 118' of the retaining member 112 are received on the curved bottom surfaces of the vertical grooves 104 and 104' in the side wall portions 56 and 56', respectively, and at the same time the snap portions 120 and 120' are received on the protruded wall portions 108 and 108', respectively, of the housing structure 52. When the retaining member 112 is fitted to the housing structure 52 in this fashion, the end portions 122 and 122' of the retaining member 112 project downwardly out of the lateral slot 106 in the bottom wall portion 60 of the housing structure 52. The end portions 122 and 122' of the retaining member 74 are then pressed toward each other against the opposing force resulting from the elasticity of thereof and are inserted through the holes 110 and 110', respectively, in the mother board 54. When the retaining member 112 is released from the pressing effort which has been applied to the end portions 122 and 122' thereof, the retaining member 112 is closely engaged by the mother board 54 which is as a consequence tightly fastened to the bottom wall portion 60 of the housing structure 52.

When the connector assembly is complete with the retaining member 112 engaged by the housing structure 52 and the mother board 54, the printed circuit board 20 is forced in between the intermediate portions 114 and 114' of the retaining member 112 until the end of the contact-carrying edge portion of the circuit board 20 is brought into contact with the inner face of the rounded middle portion 116 of the retaining member 112 as shown in FIG. 13. The printed circuit board 20 is thus closely held in position having its contact-carrying edge portion pressed between the intermediate portions 114 and 114' of the retaining member 112 so that the conductive contacts carried on the edge portion are maintained in close contact with the contact elements 66 carried on the respective inner faces of the side wall portions 56 and 56' of the housing structure 52.

Figure 15:
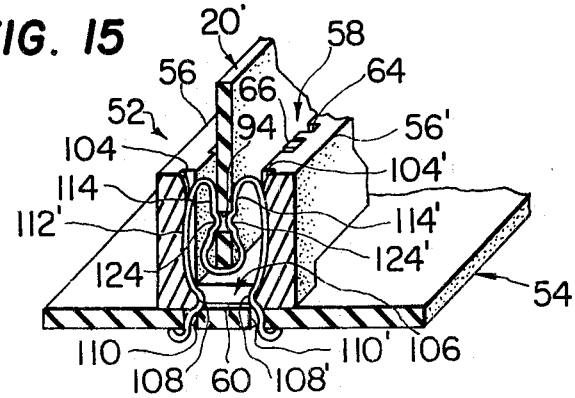
FIG. 15 is a fragmentary perspective view showing a modification of the embodiment illustrated in FIG. 14.

FIG. 15 illustrates a modification of the embodiment which has been described with reference to FIGS. 13 and 14. Referring to FIG. 14, the connector assembly herein shown is adapted for use with a printed circuit board 20' which is formed with an aperture 94 in its contact-carrying edge portion and comprises an elastic retaining member 112'. The elastic retaining member 112' is configured largely similarly to the retaining member 112 shown in FIG. 14 and has intermediate portions 114 and 114', a rounded middle portion 116 interconnecting the intermediate portions 114 and 114', side arm portions 118 and 118' extending sidewise outwardly of the intermediate portions 114 and 114', respectively, snap portions 120 and 120' laterally inwardly curved from the leading ends of the side arm portions 118 and 118', respectively, in conformity to the surfaces of the protruded wall portions 108 and 108' of the housing structure 52, and end portions 122 and 122' laterally outwardly curved from the snap portions 120 and 120', respectively. In addition to these portions of the retaining member 112 shown in FIG. 14, the retaining member 112' of the embodiment shown in FIG. 15 has inward protrusions 124 and 124' in its intermediate portions 114 and 114', respectively. The projections 124 and 124' are substantially semicircularly curved laterally inwardly toward each other and are located to be in alignment with the aperture 94 in the printed circuit board 20 which is held in the position having its contact-carrying edge portion pressed between the intermediate portions 114 and 114' of the retaining member 112'. When the contact-carrying edge portions of the printed circuit board 20 is thus captured between the intermediate portions 114 and 114' of the retaining member 112' the protrusions 124 and 124' respectively formed in the intermediate portions 114 and 114' are closely received in the aperture 94 and thus prevent the printed circuit board 20 from being dislodged or dislocated from its predetermined initial position relative to the housing structure 52. Where the printed circuit board 20 is fitted to the connector assembly by manual operation, the projections 124 and 124' formed in the retaining member 112' will facilitate the operator to preceive proper engagement achieved between the printed circuit board 20 and the retaining member 112' by the snap actions of the protrusions 124 and 124' received in the aperture 94 in the circuit board 20.

Figure 16:
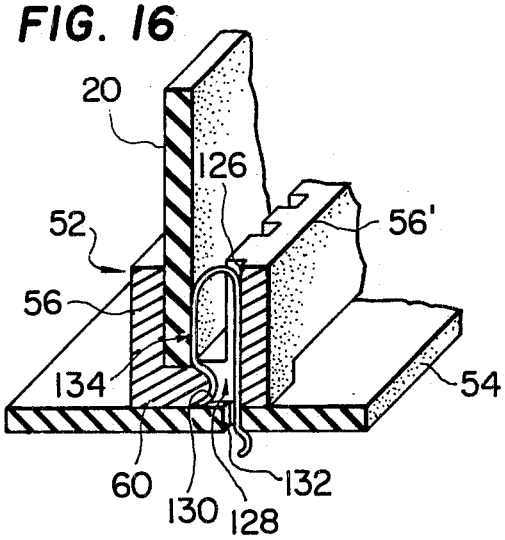
FIG. 16 is a fragmentary perspective view which shows still another preferred embodiment of the connector assembly according to the present invention.
Figure 17:
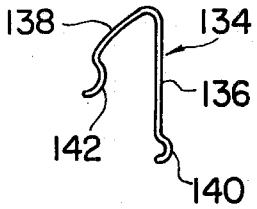
FIG. 17 is a perspective view showing an unstressed condition of a retaining member forming part of the embodiment illustrated in FIG. 16.

FIG. 16 illustrates still another preferred embodiment of the connector assembly according to the present invention. In the embodiment herein shown, the housing structure 52 having side wall portions 56 and 56' and a bottom wall portion 60 has elastic contact elements (not shown) carried on the inner face of only one side wall portion 56 thereof and is thus assumed to be used for the mounting of a printed circuit board 20 having conductive contacts (not shown) printed on only one of the surfaces thereof. The housing structure 52 has formed in its side wall portion 56' a vertical groove 126 extending between the upper and lower ends of the inner face of the wall portion 56' and in its bottom wall portion a lateral slot 128 having one lateral end joining the vertical groove 126 and the other lateral end defined by the surface of a substantially semicircularly protruded wall portion 130. On the other hand, the mother board 54 is formed with an aperture 132 which is located in alignment with the vertical groove 126 in the side wall portion 56' and accordingly with one end of the slot 128 in the bottom wall portion 60 of the housing structure 52. The housing structure 52 and the mother board 54 thus configured are combined together by means of a retaining member 134 which has an unstressed condition illustrated in FIG. 17. The retaining member 134 is formed of an elastic metal wire such as a music wire and comprises a substantially straight side arm portion 136, a curved side arm portion 138 merging out of the straight side arm portion, a laterally outwardly curved end portion 140 extending from the leading end of the straight side arm portion 136 and a laterally inwardly curved semicircular end portion 142 extending from the leading end of the curved side arm portion 138. The semicircular end portion 142 is curved in conformity to the surface of the semicircularly protruded wall 130 defining one end of the slot 128 in the bottom wall portion 60 of the housing structure 52. The retaining member 134 configured in this fashion is fitted to the housing structure 52 in such a manner that the straight side arm portion 136 is received partly in the vertical groove 126 in the side wall portion 56' and partly in one end of the lateral slot 128 in the bottom wall portion 60 with the laterally outwardly curved end portion 140 projecting out of the lower end of the bottom wall portion 60 of the housing structure 52. The laterally inwardly curved end portion 142 of the retaining member 134 is closely received on the surface of the semicircularly protruded wall portion 130 defining the other end of the lateral slot 128 in the bottom wall portion 60 so that the curved side arm portion 138 of the retaining member 134 extends over the inner face of the side wall portion 56 of the housing structure 52. The retaining member 134 is then fitted to the mother board 54 in such a manner that the lowermost part of the straight side arm portion 136 is passed through the aperture 132 in the mother board 54 and the laterally outwardly curved end portion 140 projects downwardly from the lower face of the mother board 54, as seen in FIG. 16. The printed circuit board 20 is held in position between the inner face of the side wall portion 56 of the housing structure 52 and the curved side arm portion 138 of the retaining member 134 as illustrated in FIG. 16 so that one surface of the circuit board 20 is spaced apart from the inner face of the side wall portion 56' of the housing structure 52 and the other surface, viz., the contact-carrying surface of the board 20 is in pressing contact with the contact elements (not shown) on the inner face of the side wall portion 56 of the housing structure 52.

FIG. 18 illustrates still another preferred embodiment of the connector assembly according to the present invention. The connector assembly herein shown is also assumed to have contact elements (not shown) carried on only one of its side wall portions 56 and 56' of the housing structure 52 and is thus adapted for use with a printed circuit board having contacts printed on only one surface thereof. The printed circuit board has formed an aperture 94 in its contact-carrying edge portion and is thus designated by 20'. The side wall portion 56' of the housing structure 52 has formed at its top a generally square-shaped recess 144 which is open to the elongated groove 58 between the inner faces of the side wall portions 56 and 56'. On the other hand, the bottom wall portion 60 of the housing structure 52 is formed with a slot 146 which is aligned with the top recess 144 in the side wall portion 56' in the lateral direction of the housing structure 52. The housing structure 52 thus configured is fitted with a retaining member 148 which is formed of an elastic metal wire and which is composed of an intermediate portion 150 having a laterally outward protrusion 152 adapted to be partly received in the aperture 94 in the printed circuit board 20, an upper end portion 152 substantially perpendicularly bent or curved from the intermediate portion 150 and is adapted to fit into the top recess 144 in the side wall portion 56', a snap portion 156 laterally outwardly curved from the lower end of the intermediate portion 150 in a direction laterally opposite to the protrusion 152 and configured to be in conformity to the wall defining the end of the slot 146 in the bottom wall portion 60 of the housing structure 52 and a lower end portion 158 substantially perpendicularly curved from the lower end of the snap portion 156. The retaining member 148 configured in this fashion is fitted to the housing structure 52 in such a manner that the laterally outwardly bent or curved upper end portion 154 thereof is received in the top recess 144 in the side wall portion 56' and the snap portion 156 is passed through the slot 146 in the bottom wall portion 60 of the housing structure 52 with the lower end portion 158 at least partly in contact with the lower face of the bottom wall portion 60 of the housing structure 52. When the apertured printed circuit board 20' is held in a predetermined relative position relative to the housing structure 52 illustrated in FIG. 18, the laterally outward protrusion 152 of the intermediate portion 150 of the retaining member 148 is partly received in the aperture 94 in the printed circuit board 20' which consequently has its contact-carrying edge portion pressed against the elastic contact elements (not shown) carried on the inner face of the side wall portion 56 of the housing structure 52. Under these conditions, the upper end portion 154 of the retaining member 148 has its end in pressing contact with the laterally outer end surface defining the recess 144 so that the intermediate portion 150 of the retaining member 148 is at least in part held in pressing engagement with the printed circuit board 20'. If desired, the recess 144 formed in the top wall of the side wall portion 56' of the housing structure 52 may be stepped laterally outwardly in the side wall portion 56' in the longitudinal direction of the wall portion 56', having laterally outer ends defined by first and second wall surfaces **144*a* and 144*b* located at different distances from the laterally inner end of the side wall portion 56', as seen in FIG. 18*a*. In the arrangement shown in FIG. 18*a*, it is assumed that the first wall surface 144*a* is located at a smaller distance from the laterally inner end of the side wall portion 56' than the second wall surface 144*b* so that the pressing force exerted by the retaining member 148 on the printed circuit board 20 can be varied stepwise depending upon the relative position of the upper end portion 154 of the retaining member 148 in the recess 144. If, thus, it is desired that the printed circuit board 20' be forced against the contact elements (not shown) on the side wall portion 56 of the housing structure 52 with a relatively large pressure, the retaining member 148 should be positioned to have its upper end portion 154 received on the first end surface 144*a* as indicated by full lines in FIG. 18*a*. In this instance, the printed circuit board 20' may be easily removed from the housing structure 52 by moving the upper end portion 154 of the retaining member 148 from the position engaging the first end surface 144*a* to the position engaging the second end surface 144*b* as indicated by broken lines in FIG. 18*a*. If, conversely, the printed circuit board 20' is desired to be forced against the contact elements with a reduced pressure, then the retaining member 148 should be positioned to have its upper end portion 154 received on the second end surface 144*b*. If desired, the recess 144 may be formed with three or even more stepped walls so as to enable the retaining member 148 to have the printed circuit board 20' forced against the contact elements on the side wall portion 56'** with a force which may be adjusted more minutely.

While the retaining member incorporated into each of the various embodiments of the connector assembly according to the present invention has been described and shown to be formed separately of the housing structure, the retaining member may be formed integrally with the housing structure, if desired. FIG. 19 illustrates an embodiment of the connector assembly having such retaining means. Referring to FIG. 19, the housing structure 52 is also assumed to be adapted for use with a printed circuit board 20 having contacts (not shown) carried on only one of the surfaces thereof and has a side wall portion 56 carrying elastic contact elements (not shown) on its face and a side wall portion 56' spaced apart in parallel from the contact-carrying side wall portion 56 for forming an elongated groove 58 therebetween. The side wall portion 56' is formed with an obtusely bifurcated projection 160 projecting substantially perpendicularly from the inner face of the side wall portion 56' into the elongated groove 58 between the side wall portions 56 and 56'. The bifurcated projection 160 is composed of a pair of angularly spaced arm portions **160*a* and 160*b* extending over the inner face of the side wall portion 56' in vertical direction of the housing structure 52. The arm portions 160*a* and 160*b* have respective free ends which are equally spaced apart from the inner face of the side wall portion 56 carrying the contact elements so that the printed circuit board 20 positioned between the inner face of the contact-carrying side wall portion 56 and the bifurcated projection 160 of the side wall portion 56' as illustrated is elastically pressed against the contact elements on the side wall portion 56 partly by reason of the elasticity of the arm portions 160*a* and 160*b* of the projection 160 on the side wall portion 56' formed of an elastic material and partly by reason of the elasticity of the contact elements on the side wall portion 56**.

From the foregoing description, it will now be appreciated that the connector assembly embodying the present invention will prove advantageous over prior art connector assemblies for printed circuit board in the following respects:

1° The housing structure can be easily and tightly connected to the mother board by the simple steps to fit the retaining members to the housing structure and the mother board without aid of any extra fastening means such as screws used in a prior art connector assembly.

2° The printed circuit board is elastically held in a fixed position relative to the housing structure by means of the retaining members formed of elastic material so that the shocks and impacts which may be imparted to the connector assembly are alleviated before they reach the printed circuit board or the shocks and impacts imparted directly to the printed circuit board are absorbed by the elastic deformation of the retaining members. As a consequence, fluctuations in the contact pressure between the contacts on the printed circuit board and the contact elements on the housing structure can be lessened so that the contact resistance between the contacts on the circuit board and the contact elements on the housing structure can be maintained substantially constant. This will result in prolonged service lives of the printed circuit board and the connector assembly.

3° The printed circuit board is prevented from being dislocated or dislodged from its initial predetermined position relative to the housing structure by the retaining members tightly engaging the circuit board and the connector assembly.

4° In the absence of any extra fastening means provided to combine the housing structure and the mother board in a prior art connector assembly, the overall dimensions of the connector assembly can be reduced to a minimum.

While a variety of preferred embodiments of the connector assembly according to the present invention have thus far been described with reference to the accompanying drawings, it should be borne in mind that such embodiments are merely for the purpose of illustration of the gist of the present invention and are therefore subject to change and alteration if desired. Although, for example, each of the embodiments has been shown provided with only one retaining member, such is solely for the simplicity of description and illustration and, thus, each of the embodiments may be provided with a desired number of retaining members each of which is constructed and arranged in a manner herein proposed. If desired, moreover, retaining member incorporated in each of the embodiments thus far described may be formed of a conductive material and used as a conductor providing electrical connection between the contacts on the printed circuit board and the contact elements on the housing structure of the connector assembly.

What is claimed is:

1. A connector assembly for a printed circuit board having a contact-carrying edge portion having a plurality of electrical contacts on at least one face of the contact-carrying edge portion, comprising: an electrically non-conductive housing structure having a pair of spaced parallel side wall portions forming therebetween an elongated groove which is open at its top, and a bottom wall portion having an inner face at the bottom of said groove; a plurality of electrical contact elements mounted on the inner face of at least one of said side wall portions; a mother board in contact with the outer face of the bottom wall portion of said housing structure; and at least one retaining member consisting of an elastic metal wire element and in elasticity pressing contact in part with the inner face of at least one of said side wall portions of the housing structure and in part with at least one of the opposite faces of said contact-carrying edge portion of the printed circuit board for thereby holding the printed circuit board in a predetermined fixed position having said contacts respectively in contact with said contact elements on the housing structure, said retaining member being electrically isolated from all of said contacts and said contact elements and having at least one end portion projecting outwardly from said bottom wall portion of the housing structure, said end portion being laterally curved and being at least partially in elastically pressing contact with the outer face of said mother board for holding said mother board against the outer face of said bottom wall portion of said housing.

2. A connector assembly as set forth in claim 1, in which said retaining member has a pair of side arm portions spaced apart from each other in lateral direction of said housing structure and in elastically pressing contact with the respective inner faces of the side wall portions of the housing structure, a pair of intermediate portions each turning backwardly from one end of each of said arm portions and extending substantially in parallel with each of the side arm portions and within said housing structure, a curved middle portion through which said intermediate portions merge with each other, the intermediate portions being in elastically pressed contact with the respective opposite faces of said contact-carrying edge portion of the printed circuit board with said middle portion in contact with the end face of said edge portion for thereby retaining the circuit board partly with the intermediate portions, and a pair of end portions each merging out from the other end of each of said side arm portions and projecting outwardly from said mother board through the bottom wall of the housing structure and in elastically pressing engagement at its end with the outer face of the mother board.

3. A connector assembly as set forth in claim 1, in which said printed circuit board is formed with an aperture in the contact-carrying edge thereof and in which said intermediate portions of said retaining member have respective inward protrusions which are curved toward each other and which are elastically received in said aperture.

4. A connector assembly as set forth in claim 1, in which said end portions of said retaining member are laterally outwardly curved away from each other and are in elastically pressing contact at their respective ends with the outer face of said mother board.

5. A connector assembly as set forth in claim 4, in which said bottom wall portion of said housing structure is formed with a lateral slot having lateral ends below the respective inner faces of the side wall portions of the housing structure and in which said mother board is formed with apertures located below said lateral ends of said slot, said end portons of said retaining member projecting outwardly from said mother board through said slot and respectively through said apertures.

6. A connector assembly as set forth in claim 5, in which said housing structure has inner surface portions defining said lateral ends of said slot in the bottom wall portion of the housing structure and in which said retaining member further has a pair of snap portions each extending between each of said side arm portions and each of said end portions of the retaining member, said snap portions being in elastically pressing contact with said respective inner surface portions of the housing structure.

7. A connector assembly as set forth in claim 2, in which each of said side wall portions of said housing structure has formed therein a groove open to said elongated groove and extending between the top and bottom of the elongated groove, said side arm portions of said retaining member being elastically received respectively in the grooves in the side wall portions.

8. A connector assembly as set forth in claim 1, in which said retaining member has a first side arm portion in elastically pressing contact with the inner face of one of said side portions of said housing structure and a second side arm portion in elastically pressing contact with one surface of the contact-carrying edge portion of said printed circuit board.

9. A connector assembly as set forth in claim 8, in which said printed circuit board has one face of the contact-carrying edge portion thereof in contact with the inner face of one of said side wall portions of said housing structure and the other face of said edge portion laterally spaced apart from the inner face of the other of said side wall portions, said bottom wall portion of the housing structure being formed with a lateral slot having one lateral end located below the inner face of said other of said side wall portions and the other lateral end located below said other face of said contact-carrying edge portion of the printed circuit board and said mother board being formed with an aperture located below said one lateral end of said slot, said bottom wall portion of the housing structure having a first inner surface portion defining said one lateral end of said slot in the bottom wall portion of the housing structure and a second inner surface portion at said other lateral end of said slot, said retaining member having said first side arm portion in part in elastically pressing contact with said first inner surface portion and in part inserted through said aperture in the mother board, the retaining member further having a first end portion merging out of said first side arm portion and projecting outwardly from said aperture in the mother board and a second end portion in elastically pressing contact with said second inner surface portion of the bottom wall portion of the housing structure.

10. A connector assembly as set forth in claim 9, in which said secondinner surface portion of the bottom wall portion of said housing structure is substantially semicircular and protrudes toward said first inner surface portion and in which said second end portion is curved and conforms to said second inner surface portion.

11. A connector assembly as set forth in claim 10, in which said one of said side wall portions of the housing structure is formed with a groove terminating at said one lateral end of said slot in the bottom wall portion of the housing structure and in which said first arm portion of the retaining member is elastically received in said groove in the side wall portion.

12. A connector assembly as set forth in claim 1, in which said printed circuit board has one face of the contact-carrying edge portion thereof in contact with the inner face of one of said side wall portions of the housing structure and the other face of the contact-carrying edge portion laterally spaced apart from the inner face of the other of said side wall portions, said other of the side wall portions having formed in the top wall thereof a recess open to the elongated groove in said housing structure and the bottom wall portion of the housing structure being formed with an aperture open to the bottom of said elongated groove, said retaining member having an intermediate portion in elastically pressing contact with said other face of the contact-carrying edge portion of the printed circuit board, a first end portion curved laterally outwardly from one end of said intermediate portion with respect to the housing structure and elastically received in said recess in the housing structure, and a second end portion extending from the other end of said intermediate portion of the retaining member, the second end portion being in part elastically received in said aperture in the bottom wall portion of the housing structure and in part in elastically pressing contact with the outer face of said bottom wall portion.

13. A connector assembly as set forth in claim 12, in which said printed circuit board has an aperture formed in the contact-carrying edge portion thereof and in which said intermediate portion of said retaining member has a laterally outward protrusion which protrudes laterally away from the inner face of said other of said side wall portions of the housing structure and which is elastically received in said aperture in the printed circuit board.

* * * * *